United States Patent [19]

Baldyga

[11] 4,432,664

[45] Feb. 21, 1984

[54] BOAT HOIST

[75] Inventor: Joseph W. Baldyga, Mt. Clemens, Mich.

[73] Assignee: Duraline Products Corporation, Mich.

[21] Appl. No.: 239,174

[22] Filed: Mar. 3, 1981

[51] Int. Cl.[3] ..... B63C 3/06
[52] U.S. Cl. ..... 405/3; 405/221
[58] Field of Search ..... 405/1, 3, 4, 221

[56] References Cited

U.S. PATENT DOCUMENTS

| | | | |
|---|---|---|---|
| 3,177,668 | 4/1965 | Schneider et al. | 405/3 |
| 3,276,211 | 10/1966 | Drake | 405/3 |
| 3,284,052 | 11/1966 | Godbersen | 405/3 |
| 3,841,441 | 10/1974 | Klinkhammer et al. | 405/3 X |

*Primary Examiner*—David H. Corbin
*Attorney, Agent, or Firm*—Barnes, Kisselle, Raisch, Choate, Whittemore & Hulbert

[57] ABSTRACT

A boat hoist comprising a column, a tubular hoist slidable vertically, on said column, a boat cradle on said hoist, shore reinforcement means to anchor an upper part of said column to the shore, and a power unit connecting said column and hoist.

16 Claims, 10 Drawing Figures

FIG. 5
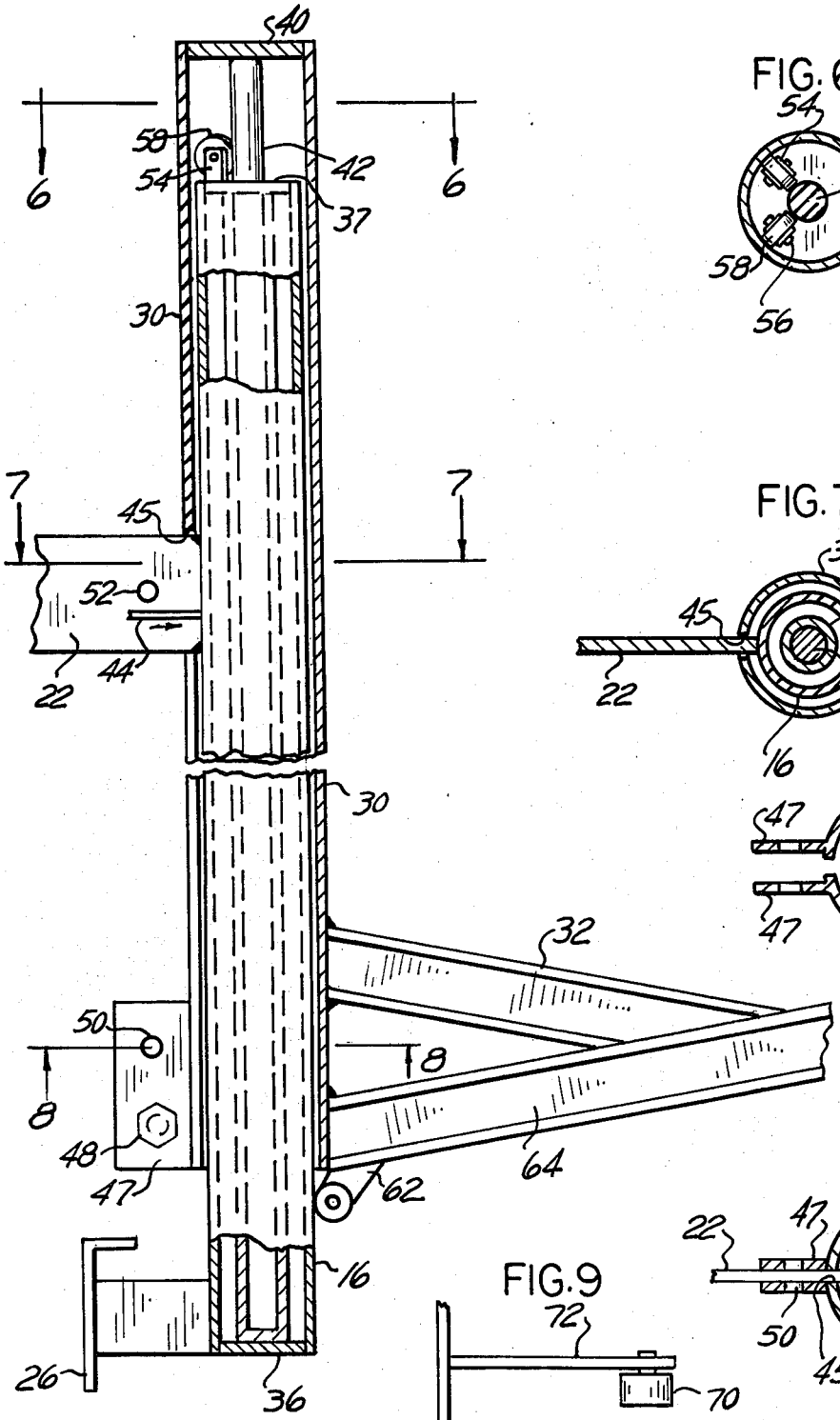
FIG. 6
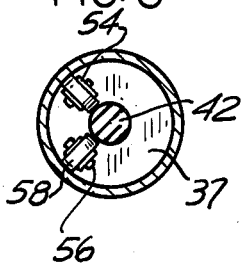
FIG. 7
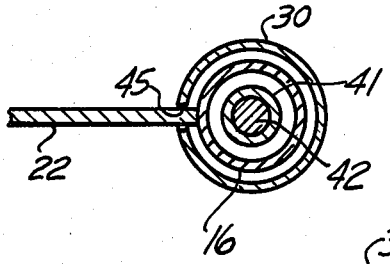
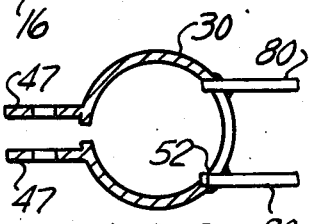
FIG. 10
FIG. 8
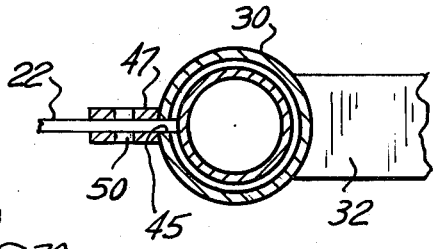
FIG. 9
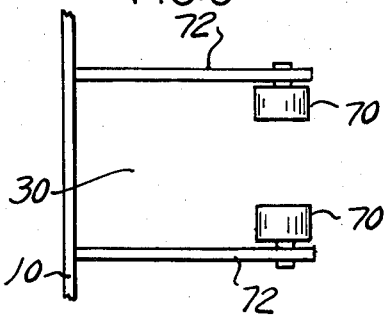

BOAT HOIST

BACKGROUND AND SUMMARY OF THE INVENTION

The present invention relates to a boat hoist.

The boat hoist is intended to be installed at water's edge, adjacent to a seawall if one is available, or a dock or the like.

In the past conventional boat hoists required unsightly overhead steel constructions, and usually a multiplicity of cables, sheaves, etc., all of which is avoided with the present construction.

The boat hoist of the present invention comprises essentially a vertical column which may be driven as a pile into the water bed where the hoist is dockside, or adjacent a seawall. Alternatively, it may be secured directly to a seawall, pier, dock, or the like.

The hoist is an elongated tubular member slidable over the column, and slotted to accommodate a connection between the column and a shore based anchor or support. The hoist is raised or lowered by a power unit connected between the column and hoist. Preferably the column is tubular, and the power unit is a piston and cylinder unit located with the column.

DEFINITION OF TERMS

Herein the term seaward means a direction away from the land and toward the water, or the boat cradle.

The term shoreward means the direction opposite to seaward.

The term water bed means the soil or ground beneath the water, into which the post of the hoist construction may be driven.

BRIEF DESCRIPTION OF THE DRAWINGS

FIG. 5 is an elevational view of the hoist with parts broken away.

FIGS. 6–8 are sectional views on the lines 6—6, 7—7 and 8—8 respectively, in FIG. 5.

FIG. 9 is a diagrammatic plan view illustrating a different embodiment of the invention.

FIG. 10 is a sectional view illustrating a different mounting for the bottom roller means.

DETAILED DESCRIPTION

Figure 1:
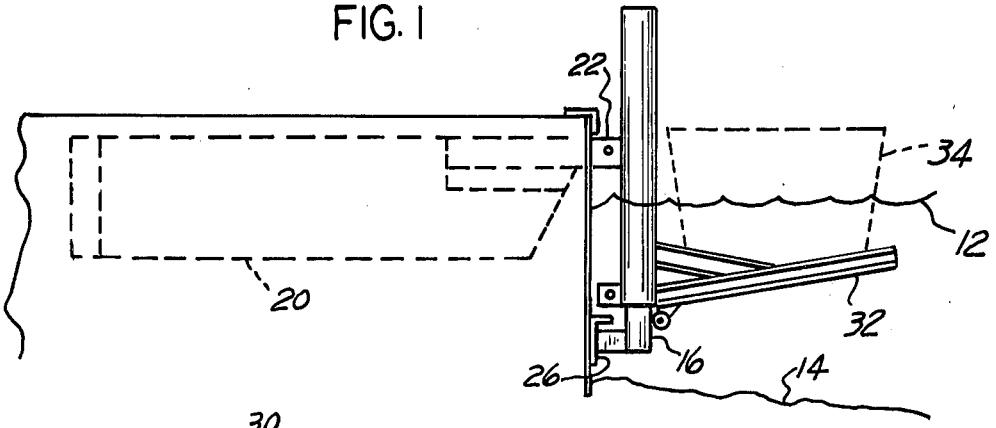
FIG. 1 is a diagrammatic elevational view with the hoist in lower position.

Referring now to the drawings, the boat hoist is intended for erection at dockside, or adjacent a seawall 10, the water level being indicated at 12 and the bed of the water being seen at 14.

Figure 2:
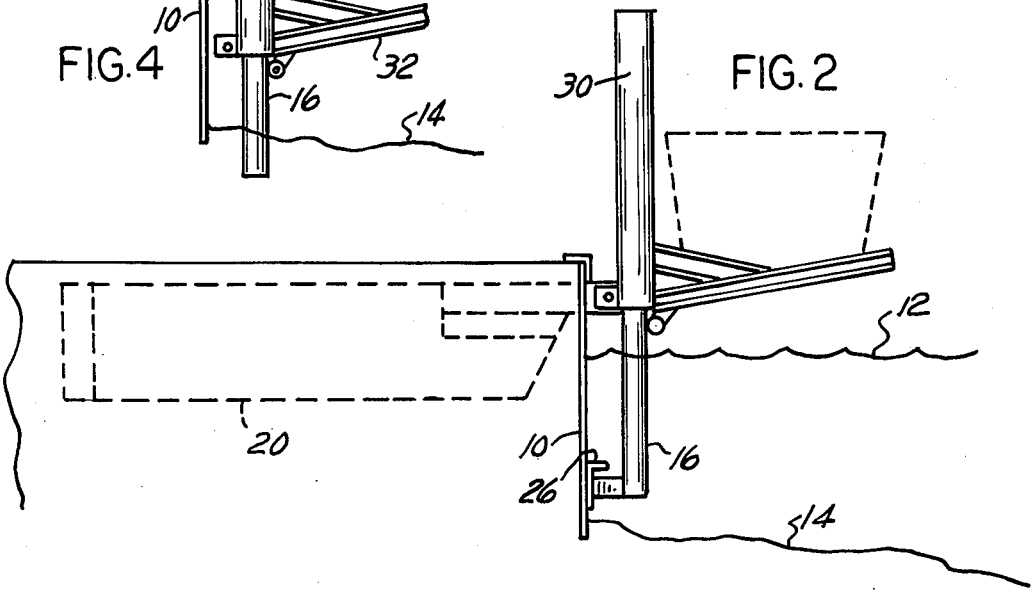
FIG. 2 is a view similar to FIG. 1 with the hoist in raised position.
Figure 3:
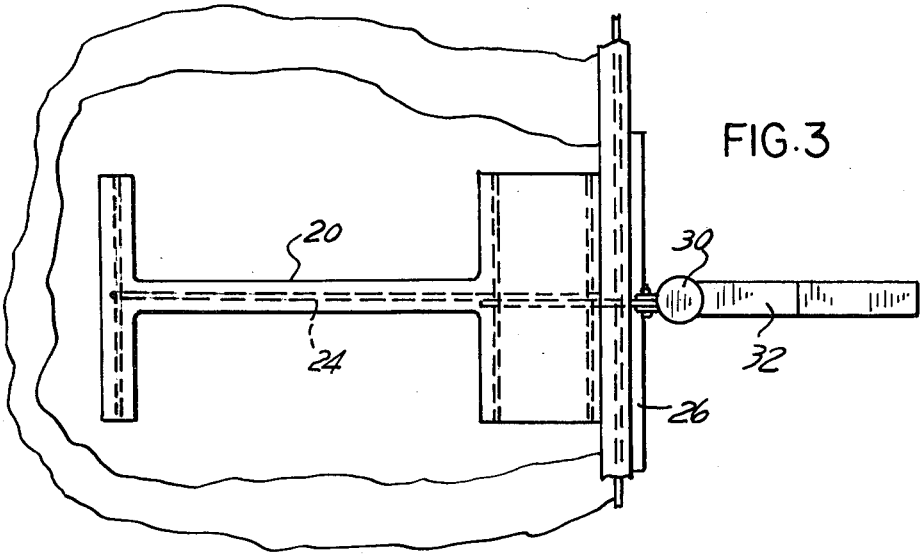
FIG. 3 is a diagrammatic plan view of the structure shown in FIGS. 1 and 2.

The hoist construction as illustrated in FIGS. 1–3 comprises a rigid post 16 adapted to be fixed to a seawall 10 and attached to a land anchor 20 by suitable tension connections indicated at 22. The land anchor may comprise a massive concrete construction buried in the soil and reinforced by metal bars or beams as indicated at 24.

The anchor connection 22 is adjacent the top of the post in position to resist forces tending to move the top of the post outwardly away from the shoreward side.

As seen in these figures the lower end of the post may be provided with a pad 26 welded or otherwise fixed to the seawall.

Figure 4:
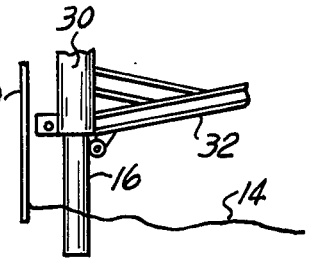
FIG. 4 is a fragmentary view showing the lower end of the support column driven into the bed of the water.

In FIG. 4 there is illustrated an alternative construction, in which the lower end of the post is driven as by a pile-driver into the water bed 14 to a depth sufficient to sustain the weight of a boat to be hoisted from the water.

In either case, vertically movable on the post 16 is a tubular hoist 30 having a boat cradle 32 of suitable design. If desired, the hoist apparatus may comprise a pair of posts, hoists and cradles in juxtaposition and suitably coordinated for simultaneous operation to engage forward and aft portions of a boat 34.

Referring now to FIGS. 5–8, details of the hoist construction are shown.

The post 16 in this Figure is shown as provided at its lower end with pad 26 for attachment to a seawall or the like, but of course as indicated in FIG. 4, it may be pile driven into the bed or bottom below the surface of the water. The bottom end of the post 16 is closed as indicated at 36. In a practical design of this construction pipe 16 may be of 6″ diameter.

Telescoped over the post 16 is a tubular hoist which in the above mentioned design is an 8″ diameter pipe having an upper end closure 40 welded to hoist pipe 30. The weld connection is sufficiently strong to sustain a lifting force required to hoist a boat to a storage position above the water.

Since the shore connection 22 is located near the upper end of post 16 the hoist 30 must be slotted from its lower end to a height sufficient to receive connection 22 when the hoist is in lowered position. In the practical design referred to, provision is made for 8′ travel of the hoist. The connection 22 is a flat steel plate welded along one edge to the post.

The slot in the tubular hoist is seen at 45. In order to reinforce the slotted portion of the hoist flanges 47 are welded to the outside of the tubular hoist at the sides of the slot and are bolted together as indicated at 48. Bolt 48 are so located that when the tubular hoist is in uppermost position, it is below the anchor connection 22.

Within the post 16 is a hydraulic cylinder 41 which preferably rests on bottom closure plate 36 and the cylinder 41 contains a piston rod 42, the upper end of which engages beneath plate 40, and serves to lift the hoist when hydraulic fluid is admitted to the cylinder 41, as by hydraulic line 44 connected to the cylinder below the position occupied by piston 42 when the hoist is in lowered position, by a suitable internal connection, not shown.

Preferably flanges 47 are also provided with openings so adapted to receive a pin which extends through an opening 52 in the plate 22 forming part of the anchor connection, so that the tubular hoist may be mechanically locked in raised position, and pressure within the cylinder 41 released.

It will be apparent that when a heavy boat is hoisted, forces are developed tending to swing the upper end of the tubular hoist outwardly toward the boat cradle side, and at the same time forces are developed tending to swing the lower end of the hoist inwardly away from the boat cradle side. In order to sustain these forces, and at the same time to provide for vertical movement of the tubular hoist with minimum friction, roller bearings are provided.

At the top of the post 16, the plate 37 carries the pairs of brackets 54, and each pair receives a shaft 56 which supports a roller bearing 58. The two roller bearings, as best seen in FIG. 6, are spaced circumferentially to engage the inner surface of tubular hoist 30 at opposite sides of and closely adjacent to the slot 45, when the hoist is raised to a position in which the slot is at the top of post 16.

At the lower end of the tubular hoist, roller bearing means is provided which are engageable with the seaward side of the post 16. As indicated in FIG. 5, the roller means 60 may be supported by brackets 62 welded to a strut 64 of the cradle structure 32. Preferably, a pair of rollers 60 are provided at opposite sides of bracket 62, to divide the loading and to ensure stability.

Alternatively, as seen in FIG. 9, instead of the rollers 58 carried at the top of post 16 and engageable with the interior of the tubular hoist 30, a roller 70 supported for rotation on brackets 72 may engage directly against the exterior of tubular hoist 30. The brackets 72 may be fixed to a seawall 10 or suitably rigidly connected to the land-based anchor 20 as for example by being secured to said tension connection. In this case, of course, the connection 22 to the post 16 may be omitted.

In FIG. 10 there is illustrated a different mounting means. Here bracket plates 80 are welded to the tubular hoist adjacent its bottom end, and the hoist is cut away as indicated at 52 to permit a roller mounted between plates 80 to engage the seaward side of the stationary post.

In the event that a single post and tubular hoist is used, the cradle may be elongated in the direction of the length of the boat, and the top of the post may be provided with a pair of shore anchors to provide full stability for the post.

From the foregoing, it will be apparent that the boat hoist is characterized particularly by one or more stationary vertical posts, each of which has a tubular hoist which receives the post and which is vertically slidable thereon. The boat cradle which lifts the boat is a cantilever construction extending laterally from the hoist.

I claim:

1. A boat hoisting construction installed at the water's edge comprising post means positioned solely at the landward side of a boat both when water-borne in position to be hoisted and when hoisted vertically upwardly to a storage position, said post means consisting of at least one vertically elongated stationary post capable of sustaining the weight and torque of a boat to be hoisted, hoist means comprising a tubular hoist for each of said posts open at its bottom and mounted over its corresponding post to receive said post and movable vertically thereon, cradle means comprising boat cradle structure fixed to said hoist means to extend laterally therefrom in cantilever fashion to be movable therewith from a position below the bottom of a water-borne boat to be hoisted to receive a boat to an elevated position in which a boat supported thereon is raised above water level, and power lift means acting between said post means and hoist means to raise and lower said cradle means.

2. A construction as defined in claim 1, in which said post is tubular and in which said lift device is mounted within said post.

3. A construction as defined in claim 2, in which said lift device comprises a hydraulic piston and cylinder.

4. A construction as defined in claim 3, in which a closure is provided at the upper end of said post having an opening through which the piston of said device is slidable.

5. A construction as defined in claim 1, comprising land anchor means in stationary position ashore, and a tension connection between said anchor means and the upper portion of said post.

6. A construction as defined in claim 5, in which said hoist is provided with a slot extending upwardly from its bottom end to receive said tension connection and to be slidable thereover as said hoist is raised or lowered.

7. A construction as defined in claim 6, in which said tension connection is a vertically disposed flat plate welded along one vertical edge to said column, and said slot is dimensioned to fit closely with said plate.

8. A construction as defined in claim 7, comprising flanges extending vertically at the sides of the slot at the bottom end of said hoist, and fasteners connecting said flanges adapted to be applied after the hoist has been assembled over the column and moved downwardly until the location of said fastener means is below said tension connection to land anchor.

9. A construction as defined in claim 8, in which said flanges are provided with at least a pair of pin receiving openings adapted to receive a pin when the openings are above or in registration with said tension connection to lock said hoist in elevated position independently of said lift device by engagement with said tension connection.

10. A construction as defined in claim 1, in which said construction is for erection adjacent a vertical seawall, and comprising a rest pad extending laterally from said post adjacent the lower end thereof for attachment to the seawall.

11. A construction as defined in claim 1, in which said post is adapted to be pile driven into the water bed to provide the support as aforesaid.

12. A construction as defined in claim 1, comprising first roller means engaging the tubular hoist adjacent its upper portion to prevent seaward movement thereof and second roller means engaging the tubular hoist adjacent its lower end to prevent shoreward movement thereof.

13. A construction as defined in claim 12, in which said first roller means is mounted on the top of the post and engages the inner shoreward surface of the tubular hoist.

14. A construction as defined in claim 12, which comprises a tension connection extending shoreward from the top of said post, said hoist being slotted to accommodate said connection, and said roller means comprises a pair of rollers spaced apart to engage said hoist at opposite sides of said slot.

15. A construction as defined in claim 12, in which said second roller means is mounted at the seaward bottom side of said hoist to engage the seaward surface of said post.

16. A construction as defined in claim 12, in which said first roller means is engageable with the seaward outer surface of said tubular hoist, and bracket means mounting said first roller means fixed with respect to said seawall or tension means.

* * * * *